US007350322B2

(12) United States Patent
Langdon

(10) Patent No.: US 7,350,322 B2
(45) Date of Patent: Apr. 1, 2008

(54) DEWATERING SYSTEM APPARATUS AND METHOD FOR DREDGING BUCKETS

(76) Inventor: Brian Langdon, 14214 SE. 77th St., Newcastle, WA (US) 98059

( * ) Notice: Subject to any disclaimer, the term of this patent is extended or adjusted under 35 U.S.C. 154(b) by 395 days.

(21) Appl. No.: 11/097,039

(22) Filed: Apr. 1, 2005

(65) Prior Publication Data

US 2005/0241192 A1 Nov. 3, 2005

Related U.S. Application Data

(60) Provisional application No. 60/559,132, filed on Apr. 2, 2004.

(51) Int. Cl.
*B63C 7/22* (2006.01)

(52) U.S. Cl. ..... 37/317; 37/320; 37/340; 210/242.1

(58) Field of Classification Search ..... 37/317, 37/320, 340, 341; 210/242.1
See application file for complete search history.

(56) References Cited

U.S. PATENT DOCUMENTS

| | | | | | |
|---|---|---|---|---|---|
| 268,345 | A | * | 11/1882 | Wood | 37/340 |
| 692,557 | A | * | 2/1902 | Swenson | 299/36.1 |
| 1,464,718 | A | * | 8/1923 | Lovell | 37/186 |
| 2,027,409 | A | * | 1/1936 | Weeks et al. | 37/184 |
| 2,129,158 | A | * | 9/1938 | Williams | 37/309 |
| 2,144,743 | A | * | 1/1939 | Schulz | 299/8 |
| 2,177,196 | A | * | 10/1939 | Williams | 37/309 |
| 2,217,629 | A | * | 10/1940 | Williams | 37/187 |
| 2,952,083 | A | * | 9/1960 | Forkner | 37/341 |
| 3,003,265 | A | | 10/1961 | LutJens | |
| 4,150,503 | A | * | 4/1979 | Lespinasse | 37/309 |
| 4,542,929 | A | * | 9/1985 | Possinger | 294/88 |
| 4,631,844 | A | * | 12/1986 | Deal | 37/324 |
| 4,778,211 | A | | 10/1988 | Gabriel | |
| 4,858,346 | A | * | 8/1989 | Schulte | 37/184 |
| 5,029,923 | A | * | 7/1991 | Bergeron | 294/68.23 |
| 5,209,535 | A | * | 5/1993 | Bergeron | 294/68.23 |
| 5,241,764 | A | | 9/1993 | Modig | |
| 5,477,627 | A | | 12/1995 | Nolin et al. | |
| 5,501,024 | A | | 3/1996 | Bergeron | |
| 5,528,844 | A | | 6/1996 | Ellis | |

(Continued)

FOREIGN PATENT DOCUMENTS

| | | |
|---|---|---|
| JP | 355023230 | 2/1980 |

(Continued)

*Primary Examiner*—Thomas A Beach
(74) *Attorney, Agent, or Firm*—William Forster

(57) ABSTRACT

A dewatering apparatus for removing water from the interior volume of a closed, loaded clamshell dredging bucket. The dewatering system comprises at least one conduit adapted for support from a clamshell type dredging bucket. The conduit has a first end adapted for placement within the interior volume defined by a closed dredging bucket, and a lower second end disposed to allow communication between the space surrounding the exterior of the dredging bucket and the interior volume thereof. The conduit is positioned so that the first end thereof is disposed within an upper layer of retained water contained in the interior volume of a loaded clamshell dredging bucket when the same is moved to the closed position and lifted above the dredging area with a load of sediment and water therein. The upper layer of water is drained by gravity through the conduit and the lower end thereof for removal from the interior volume of the clamshell dredging bucket.

12 Claims, 4 Drawing Sheets

U.S. PATENT DOCUMENTS

| | | | | |
|---|---|---|---|---|
| 5,561,922 | A * | 10/1996 | Lynch | 37/317 |
| 6,135,290 | A * | 10/2000 | Heiple | 209/421 |
| 6,189,243 | B1 * | 2/2001 | Oikawa | 37/317 |
| 6,432,303 | B1 | 8/2002 | Chesner et al. | |
| 6,540,925 | B2 * | 4/2003 | Takahashi et al. | 210/776 |
| 6,684,536 | B2 * | 2/2004 | Anderson | 37/340 |
| 6,712,979 | B2 * | 3/2004 | Chesner et al. | 210/747 |

FOREIGN PATENT DOCUMENTS

| | | |
|---|---|---|
| JP | 358106025 | 6/1983 |
| JP | 358164831 | 9/1983 |
| JP | 362220618 | 9/1987 |
| JP | 407315758 | 12/1995 |
| WO | 9012750 | 11/1990 |

* cited by examiner

DEWATERING SYSTEM APPARATUS AND METHOD FOR DREDGING BUCKETS

This application claims the benefit of U.S. Provisional Application No. 60/559,132 filed Apr. 2, 2004.

BACKGROUND

This invention relates generally to clamshell buckets for dredging silt and sediments disposed under a body of water, and more particularly to an apparatus and method for removing excess water contained in a loaded dredging bucket.

Dredging operations in harbors, rivers and the like are commonly employed to remove silt, sediments and hazardous waste materials that accumulate over time to create hazards in such bodies of water. Typically, clamshell type dredging buckets are used to dredge these materials, and place the same on barges, trucks and/or rail cars for shipment to another location for disposal. However, during the dredging operation, it is common for large amounts of water, in addition to solids, to be retained in the bucket, and shipped with the solids, thereby decreasing the efficiency of the dredging operation. Because the cost of sediment removal is based on either volume or weight, a substantial reduction in the amount of retained water can reduce the cost of such operations. For this reason, many configurations for dredging buckets have been introduced with varying degrees of success. For example, in 1990 a PCT patent publication by Bergeron disclosed a power bucket having a plurality of openings in the side walls disposed to adjust the volume carrying capability of the bucket. This design, however, does not adapt to varying levels of liquids retained in the dredging operation.

Similarly, in 1995 U.S. Pat. No. 5,477,627 issued disclosing an apparatus for dewatering peat moss material. This apparatus included a bucket that incorporates a press chamber for pressing the water and moisture from the peat moss. Because of its construction, this invention is not adaptable for the removal of sediments because the same would be expelled along with the water.

In 1996, U.S. Pat. No. 5,501,024 issued directed to a bucket that employs a swiper plate attached to one sidewall on each side of the bucket to prevent solids from escaping from the side walls as the bucket halves are closed. The problem with this design is that it is complicated, and the reduction of retained water is minimal.

Similar to the '627 patent noted above, U.S. Pat. No. 5,528,844 issued illustrating an excavating bucket employing a compression plate hydraulically activated to press the dredged contents to remove unwanted retained water. The problem with this design is that the material would require a consistency of peat moss to be effective.

Additionally, in 2002, U.S. Pat. No. 6,432,303 issued disclosing a sediment excavator that included a bucket disposed within a bucket to minimize the dispersion of particulate matter that occurs during the dredging operation. Likewise, this design is cumbersome and provides only a minimal reduction is retained water.

Importantly, most of the above noted designs do not adequately address the problems associated with large amount of retained water that will be transported away from the dredging site along with the dredged solid materials. Because the cost of shipping and disposing of the dredged material is high, a reduction in the amount of retained water that is shipped can substantially reduce the cost of dredging.

Accordingly, a need remains for a cost effective method and apparatus to substantially reduce the amount of retained water that is present in dredging operations. For this purpose, an improved dewatering system for dredging buckets is provided.

SUMMARY

One object of the invention is to reduced the cost of dredging operations.

A second object is to provide a reduce the time required to dredge a specified area.

Another object is to increase the efficiency of the removal of solids from a dredge site.

Yet another object is to provide an inexpensive retrofit to existing dredging buckets so that retained water can easily be removed from dredging buckets.

A further object is to reduce the environmental impact on both the dredging site, and on the waste dump site.

Still another object is to reduce the amount of material that is shipped to waste dump sites.

The invention is a dewatering system and apparatus for removing retained water from the interior volume of a closed, loaded clamshell type dredging bucket. As noted above, dredging buckets are employed in dredging operations to remove silt and sediments found on the bottom of shallow and medium depth bodies of water. For this purpose, dredging buckets are lowered in such waters, and loaded with material for dredging and excavation that include solids disposed below an upper layer of retained water within the dredging bucket.

One embodiment of a dewatering system comprises at least one conduit adapted for support from a clamshell dredging bucket of the type that is movable from an open position, arranged for being lowered into an area to be dredged, to a closed position for dredging material and sediments which settle below a layer of retained water. The conduit has an elevated first end adapted for placement within the interior volume defined by a closed dredging clamshell bucket, and a lower second end disposed to allow communication between the space surrounding the exterior of the clamshell bucket and the interior volume thereof.

Accordingly, the conduit is positioned so that the first end thereof is disposed within the upper layer of retained water contained in the interior volume of a loaded clamshell bucket when the same is moved to the closed position and lifted out of the water, above the dredging area with a load of sediment and water therein. With this arrangement, portions of the upper layer of retained water are drained by gravity through the conduit for removal from the interior volume of the clamshell bucket.

In another aspect of the invention, a flexible siphon conduit is employed with separate floats disposed adjacent the first and second ends. For example, a float is attached to the siphon conduit, adjacent the first end thereof for lifting the first end upward when the clamshell bucket is placed below the water in the dredging area. Further, a second float is attached to the siphon conduit adjacent the second end thereof. The second end of the siphon conduit extends beyond the clamshell bucket, into the space surrounding the exterior of the clamshell bucket when the bucket is in the closed position, disposed above water. Similarly, this arrangement enables the second float to lift the second end of the siphon conduit to an elevated position when the clamshell bucket is lowered into the dredging area. After the clamshell bucket is closed, loaded and raised from the water, the first end of the siphon conduit is lowered into the water in the bucket, and the second end of the siphon conduit is lowered to a lower unsupported suspended position, extending over an upper perimeter edge of the clamshell bucket to allow the siphon conduit to be extended downward, over the upper perimeter edge of the clamshell bucket. This configuration advances the flow of water from the clamshell bucket, by siphoning action through the siphon conduit, out of the second end thereof for removal of water from the clamshell bucket. Importantly, with this arrangement, the siphon conduit is filled with water as the dredging bucket is lowered below the water thereby enabling the conditions for a siphon to take place through the siphon conduit after the clamshell bucket is lifted from the body of water.

The foregoing and other objects, features, and advantages of this invention will become more readily apparent from the following detailed description of a preferred embodiment which proceeds with reference to the accompanying drawings, wherein the preferred embodiment of the invention is shown and described, simply by way of illustration of the best mode contemplated of carrying out the invention. As will be realized, the invention is capable of other and different embodiments, and its several details are capable of modifications in various obvious respects, all without departing from the invention.

DETAILED DESCRIPTION OF THE PREFERRED EMBODIMENTS

Figure 1:
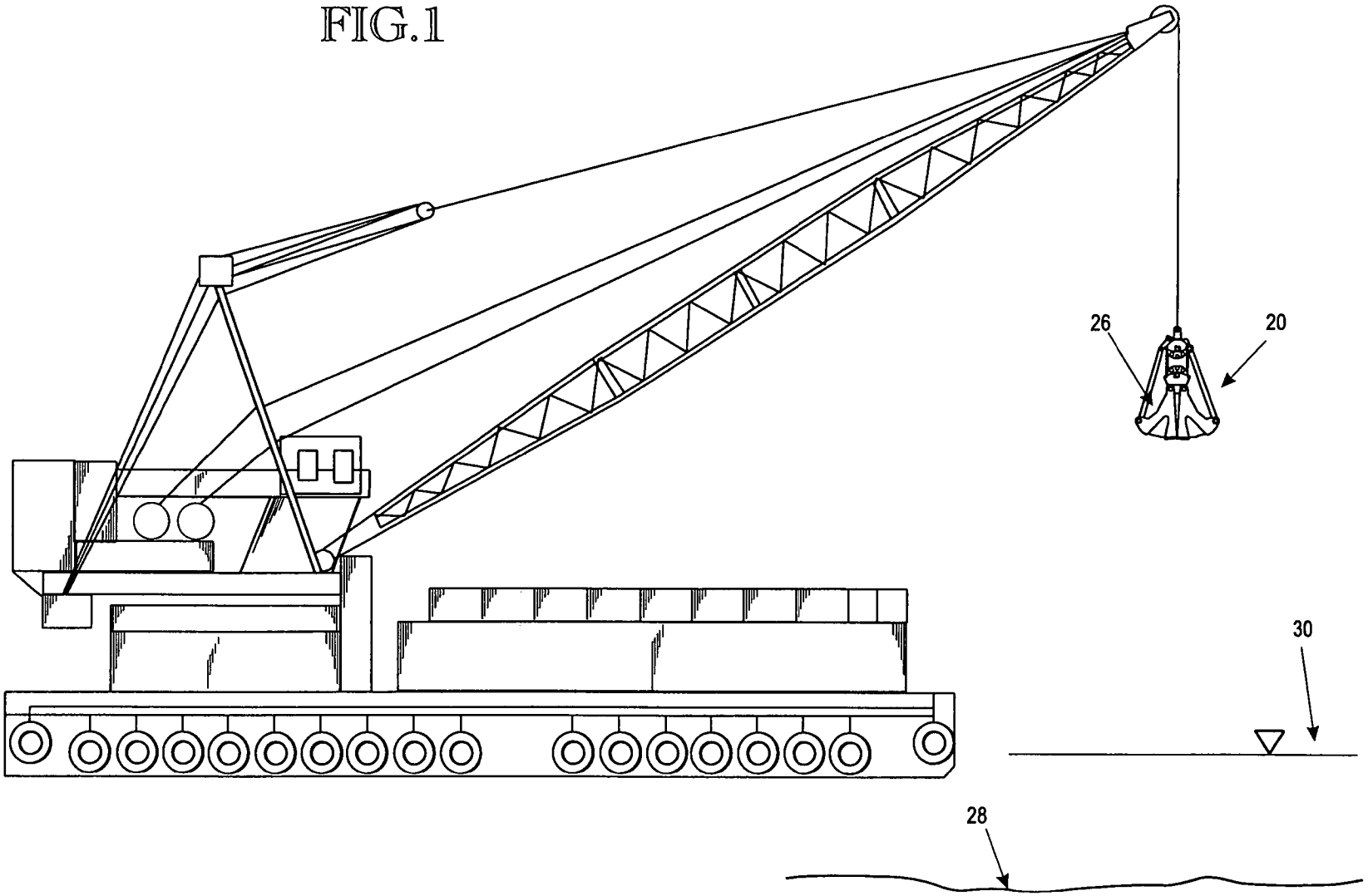
FIG. 1 is a side elevational view of a barge equipped for dredging operations with a clamshell type dredging bucket.
Figure 2:
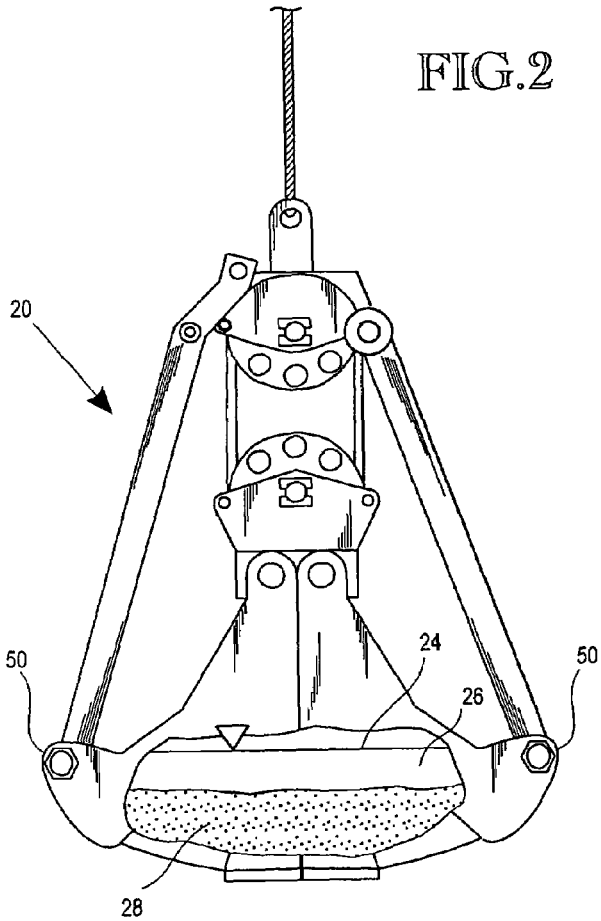
FIG. 2 is an elevational view of a clamshell bucket with portions broken away to show dredged material contained therein, with retained water disposed above the solid material as the clamshell bucket is raised from a body of water.

Referring now to the illustrations, FIGS. 1 through 6 show various configurations of a clamshell type dredging bucket 20, and configurations for a dewatering system 22 provided to remove captured and retained water 24 from the interior volume 26 of a closed dredging bucket 20. dredging buckets 20 are employed in dredging operations to remove silt and sediment 28 found on the bottom of shallow bodies of water 30. For this purpose, a dredging bucket 20 is lowered in such waters, and loaded with sediment 28 for dredging and excavation, wherein the loaded dredging bucket 20 includes solids disposed below an upper layer of retained water 24 within the dredging bucket 20.

Figure 3:
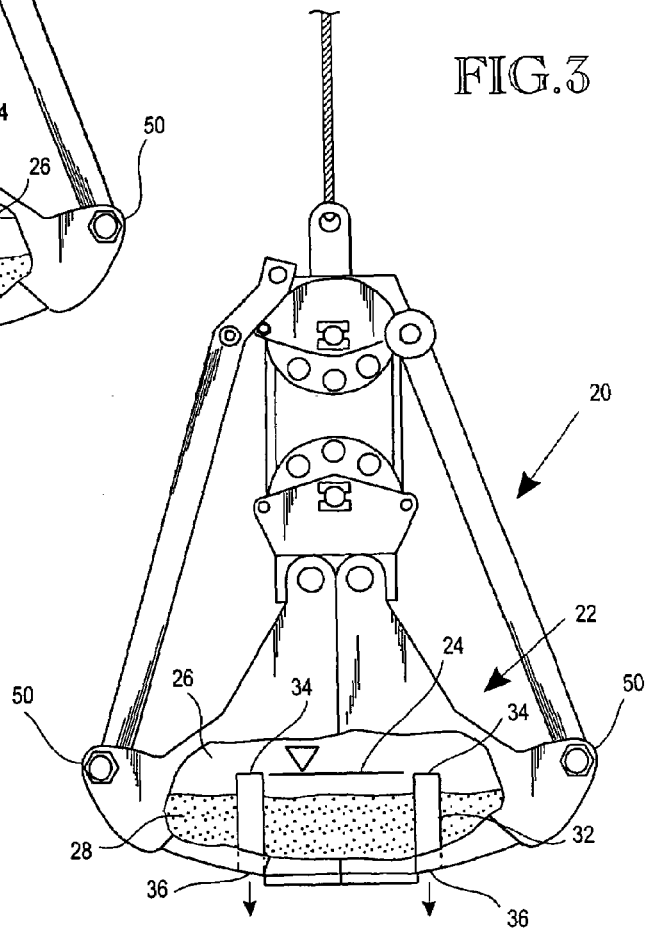
FIG. 3 is an elevational view of an embodiment of the invention illustrating drain conduits that extend upward from the bottom of a clamshell bucket that is in the closed position with the retained water level being lowered to the top of the drain conduits.

One embodiment of a dewatering system 22 comprises one or more drain conduits 32. As illustrated in FIG. 3. a pair of drain conduits 32 are adapted for support from a dredging bucket 20 of the type that is movable from an open position, similar to FIG. 4, arranged for being lowered into a body of water 24 over the dredging site, to a closed position (FIG. 3) for dredging material and sediments 28 which settle below a layer of retained water 24. Each drain conduit 32 has an elevated first end 34 adapted for placement within the interior volume 26 defined by a closed dredging bucket 20, and a lower second end 36 disposed to allow communication between the space surrounding the exterior of the dredging bucket 20 and the interior volume 26 thereof.

Accordingly, the drain conduit 32 is positioned so that the first end 34 thereof is disposed within the upper layer of retained water 24 contained in the interior volume 26 of a loaded dredging bucket 20 when the same is moved to the closed position and lifted out of the body of water 30, above the dredging area with a load of sediment 28 and retained water 24 therein. With this arrangement, portions of the upper layer of retained water 24 are drained by gravity through the drain conduit 32 for removal from the interior volume 26 of the clamshell dredging bucket 20. It should be noted that the drain conduit 32 could be constructed from any rigid or semi-rigid material including metals which would easily welded to the clamshell dredging bucket 20 at a low point in the dredging bucket 20. Moreover, as best illustrated in FIG. 3, each drain conduit 32 stands substantially vertical with the lower second end 36 fixed to the lowest portion of a closed the dredging bucket 20. To provide communication between the interior volume 26 and the space beneath the dredging bucket 20, an opening through a portion of the dredging bucket 20 is provided at the point of attachment of the drain conduit 32.

Figure 4:
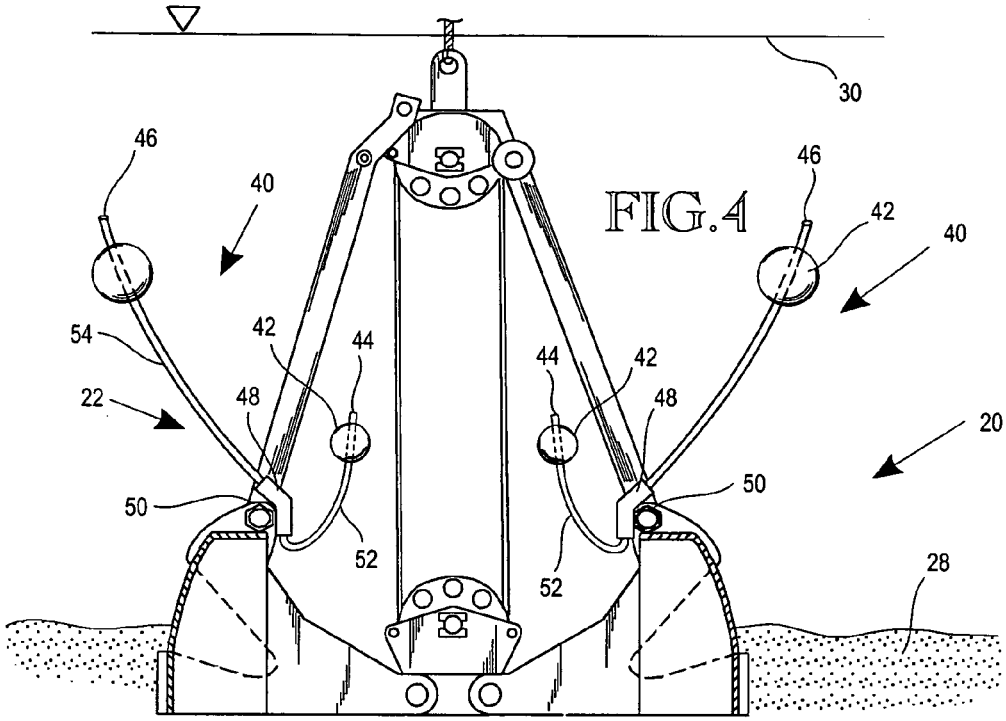
FIG. 4 is an sectional view of an embodiment of the invention illustrating flexible siphon conduits buoyed by floats to extend upward from a clamshell bucket that is in the open position disposed below the water surface at the dredging site.
Figure 5:
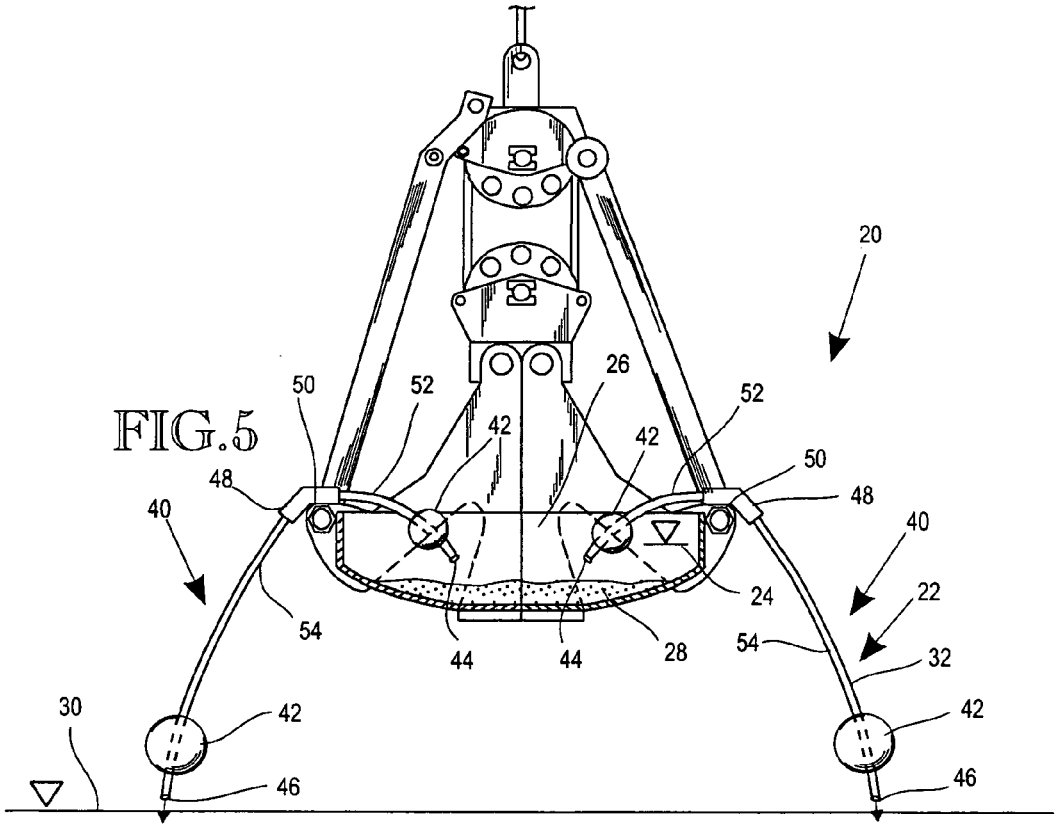
FIG. 5 is an sectional view of an embodiment of the invention illustrating siphon conduits extending downward from a clamshell bucket disposed in the closed position, loaded with material comprising retained water and solids wherein the retained water portion thereof is being siphoned through the siphon conduits to reduce the volume liquid in the clamshell bucket.

Turning now to FIGS. 4 and 5, another embodiment of a dewatering system 22 is illustrated. In particular, at lease one flexible or bendable siphon conduit 40 is employed with a separate float 42 disposed adjacent the first and second ends 44 and 46. However, as noted in the following, a rigid member could be employed if it incorporated a hinge mechanism (not illustrated). In the present invention, the siphon conduit 40 is connected to the dredging bucket 20, wherein the connection is between the first end 44 and the second end 46. More specifically, a sleeve member 48 is employed to receive the siphon conduit 40 therethrough. With this arrangement, the sleeve member 48 can be attached to the upper permeter edge 50 by any appropriate means including an adhesive or welding depending on the material of the sleeve member 48. Likewise, the siphon conduit 40 can be similarly attached to the sleeve member 48.

Accordingly, the siphon conduit 40 comprises a first portion 52 that extends from the upper perimeter edge 50 into the interior volume 26 of the dredging bucket 20. Likewise, the siphon conduit 40 comprises a second portion 54 that extends from the upper perimeter edge 50, to the space outside of the dredging bucket 20.

In addition, a float 42 is attached to the siphon conduit 40, adjacent the first end 44 thereof for lifting the first end 44 upward when the dredging bucket 20 is placed below the body of water 30 in the dredging area. One possible method of attachment would be to place the siphon conduit 40 through an opening disposed through the float 42 wherein the siphon conduit 40 could be sized to create an interference friction fit. Of course, many other way of attachment exist which are beyond the scope to this specification.

Further, a second float 42 is similarly attached to the siphon conduit 40 adjacent the second end 46 thereof. The second end 46 of the siphon conduit 40 extends beyond the clamshell bucket 20, into the space surrounding the exterior of the dredging bucket 20 when the same is in the closed position, disposed above the body of water 30.

Similarly, this arrangement enables the second float 42 to lift the second end 46 of the siphon conduit 40 to an elevated position when the dredging bucket 20 is lowered into the dredging area or body of water 30. Accordingly, when the siphon conduit 40 is in this position, the air within the siphon conduit 40 is displaced by water. After the Dredging bucket 20 is closed, loaded and raised from the water, the first end 44 of the siphon conduit 40 is lowered, by gravity, into the retained water 24 in the dredging bucket 20, and the second end 46 of the siphon conduit 40 is lowered, by gravity, to a lower unsupported position, extending over an upper perimeter edge 50 of the dredging bucket 20 to allow the siphon conduit 40 to be extended downward, over the upper perimeter edge 50 of the dredging bucket 20.

This configuration advances the flow of retained water 24 from the dredging bucket, by siphoning action through the siphon conduit 40, out of the second end 46 thereof for removal of retained water 24 from the dredging bucket 20. Importantly, with this arrangement, the siphon conduit 40 is filled with water as the dredging bucket 20 is lowered below the body of water 30 thereby enabling the conditions for a siphon to take place through the siphon conduit 40 after the dredging bucket is lifted from the body of water 30.

It should be understood that the siphon tube 40 could be constructed in many various configurations that accomplish the siphoning action as noted above. For example, the siphon conduit 40 could be made from solid tube material with an integral hinge disposed where the same is connected to the upper perimeter edge 50. In addition, the float 42 disposed at either end of the siphon tube 40 could be a typical marine type float with a center hole through which a conduit would be fitted.

Figure 6:
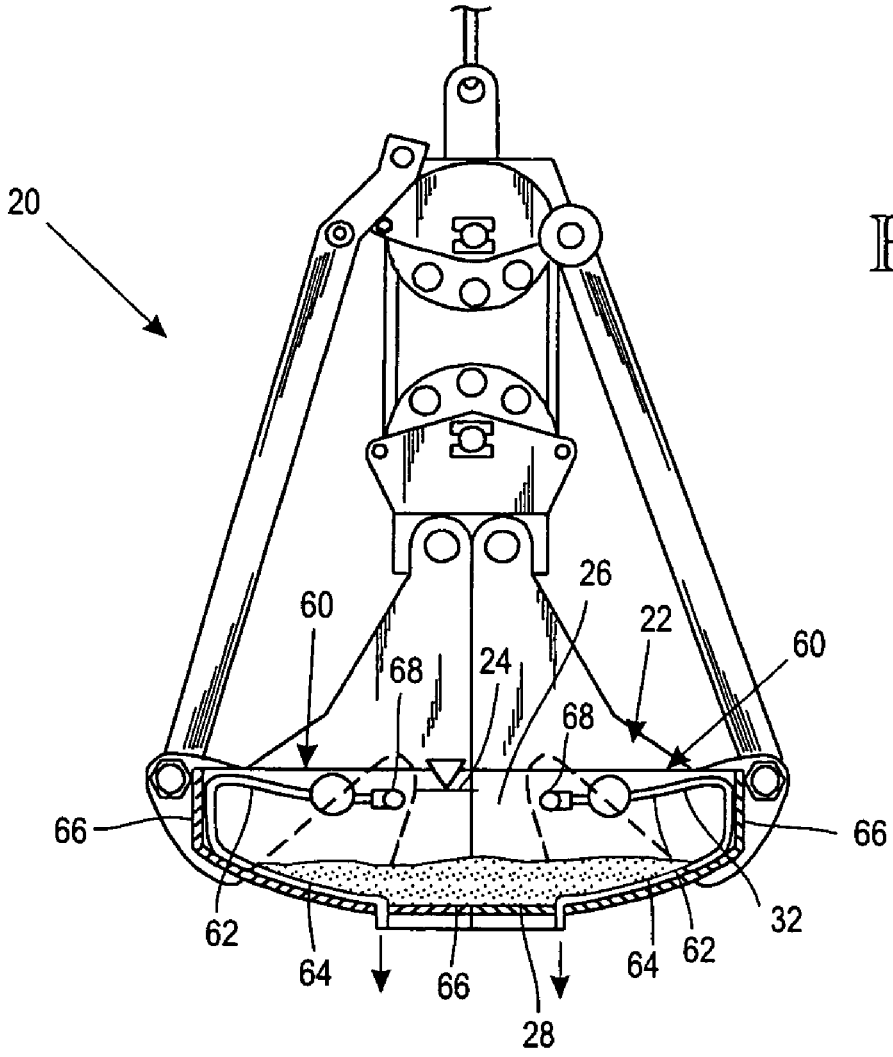
FIG. 6 is an sectional view of an embodiment of the invention illustrating siphon conduits disposed downward along the wall of a clamshell bucket disposed in the closed position, loaded with material comprising retained water and solids, wherein the retained water portion thereof is being siphoned through the drain conduits to reduce the liquid in the clamshell bucket.

Directing attention now to FIG. 6, another embodiment is illustrated where a conduit is employed that combines some of the features noted in the above described dewatering system arrangements. Specifically, a siphon conduit 60 comprises a first portion 62 that extends from the upper perimeter edge 50 into the interior volume 26 of a closed and loaded dredging bucket 20. This first portion 62 operates like the first portion 52 noted above. In contrast, however, the siphon conduit 60 includes a second portion 64 that is fixed along the interior surface 66 of the dredging bucket 20, and extends to the lowest portion of the dredging bucket 20. Accordingly, the second portion 64, is in communication with the space outside and below the dredging bucket 20 so that the retained water 24 can be siphoned from the same. Like the embodiments noted above, the second portion 64 could be constructed in various ways including being integral with the construction of the dredging bucket 20.

Having illustrated and described the principles of my invention in a preferred embodiment thereof, it should be readily apparent to those skilled in the art that the invention can be modified in arrangement and detail without departing from such principles. I claim all modifications coming within the spirit and scope of the accompanying claims.

What is claimed is:

1. A dewatering system for removing retained water from the interior volume of a closed clamshell dredging bucket loaded with excavated material that includes solids disposed below an upper layer of retained water, the dewatering system comprising:

at least one conduit adapted for support from a dredging bucket of the type that is movable from an open position arranged for being lowered into an area to be dredged, to a closed position for dredging material and sediments disposed below a surface of water in the area to be dredged;

said conduit having a first end adapted for placement within the interior volume defined by a closed dredging bucket, and a second end disposed for communication with the space surrounding the exterior of the dredging bucket, wherein the second end is disposed at a lower elevation than the first end when the dredging bucket is raised out of the dredging area;

wherein the conduit is positioned so that the first end thereof is disposed within an upper layer of retained water contained in the interior volume of a loaded dredging bucket when the same is moved to the closed position and lifted out of a dredging area, with a load of sediment and retained water, thereby allowing portions of the upper layer of retained water to drain by gravity through the conduit for removal from the interior volume of the dredging bucket; and a float disposed adjacent the first end of the conduit, secured thereto for lifting the first end to a raised elevation when the dredging bucket is placed below the surface of a body of water in a dredging area, wherein as the dredging bucket is raised from the body of water, the position of the float maintains the first end of the conduit adjacent the surface of retained water disposed within the dredging bucket as the retained water drains from the interior volume of the dredging bucket.

2. A dewatering system as recited in claim 1 further comprising a second float disposed adjacent the second end of the conduit, secured thereto, wherein the conduit is attached to the dredging bucket such that it extends over a perimeter edge of the dredging bucket, into the space surrounding the exterior of the dredging bucket to enable the second float to lift the second end of the conduit to an elevated, floated position, when the dredging bucket is lowered into the dredging area, to enable the displacement of air in the conduit with water, so that as the dredging bucket is raised from the body of water, the second end of the conduit descends into a freely suspended position from the dredging bucket, thereby creating a siphon to advance a flow of water from the dredging bucket, through the conduit, out of the second end thereof for removal of retained water back to the dredging site.

3. A dewatering system as recited in claim 1 further comprising a second float disposed adjacent the second end of the conduit, secured thereto, wherein the conduit is attached to the dredging bucket such that it extends over a perimeter edge of the dredging bucket, into the space surrounding the exterior of the dredging bucket to enable the second float to lift the second end of the conduit to an elevated, floated position, when the dredging bucket is lowered into the dredging area, to enable the displacement of air in the conduit with water, so that as the dredging bucket is raised from the dredging area, above the water surface, the second end of the conduit descends into a freely suspended position from the dredging bucket, thereby creating a siphon to advance a flow of water from the dredging bucket, through the conduit, out of the second end thereof for removal of retained water back to the dredging site.

4. A dewatering system as recited in claim 3 further comprising a member to receive and secure the conduit to the dredging bucket as it extends over a perimeter edge thereof, into the space surrounding the exterior of the dredging bucket.

5. A method of dewatering a closed clamshell dredging bucket to remove retained water from the interior volume thereof after the dredging bucket is loaded with excavated material that includes solids disposed below an upper layer of retained water, the method comprising the steps:

providing at least one conduit adapted for support from a dredging bucket of the type that is movable from an open position arranged for being lowered into an area to be dredged, to a closed position for dredging material and sediments disposed below a surface of water in the area to be dredged;

placement of a first end of said conduit within the interior volume defined by a closed dredging bucket, wherein the conduit includes a second end disposed for communication with the space surrounding the exterior of the dredging bucket, the second end being disposed at a lower elevation than the first end when the dredging bucket is raised out of the dredging area; and positioning the conduit so that the first end thereof is disposed within an upper layer of retained water contained in the interior volume of a loaded dredging bucket when the dredging bucket is moved to the closed position and lifted out of a dredging area, with a load of sediment and retained water, thereby allowing portions of the upper layer of retained water to drain by gravity through the conduit for removal from the interior volume of the dredging bucket.

6. A method of dewatering a closed clamshell dredging bucket as recited in claim 5 further comprising the step of providing a float disposed adjacent the first end of the conduit, secured thereto for lifting the first end to a raised elevation when the dredging bucket is placed below the surface of a body of water in a dredging area, wherein as the dredging bucket is raised from the body of water, the position of the float maintains the first end of the conduit adjacent the surface of retained water disposed within the dredging bucket as the retained water drains from the interior volume of the dredging bucket.

7. A method of dewatering a closed clamshell dredging bucket as recited in claim 6 further comprising the step of providing a second float disposed adjacent the second end of the conduit, secured thereto, wherein the conduit is attached to the dredging bucket such that it extends over a perimeter edge of the dredging bucket, into the space surrounding the exterior of the dredging bucket to enable the second float to lift the second end of the conduit to an elevated, floated position, when the dredging bucket is lowered into the dredging area, to enable the displacement of air in the conduit with water, so that as the dredging bucket is raised from the body of water, the second end of the conduit descends into a freely suspended position from the dredging bucket, thereby creating a siphon to advance a flow of water from the dredging bucket, through the conduit, out of the second end thereof for removal of retained water back to the dredging site.

8. A method of dewatering a closed clamshell dredging bucket as recited in claim 5 wherein the conduit extends from the interior volume of the dredging bucket, over an upper perimeter edge thereof, to the space surrounding the exterior of the dredging bucket.

9. A method of dewatering a closed clamshell dredging bucket as recited in claim 8 further comprising the step of providing a second float disposed adjacent the second end of the conduit, secured thereto, wherein the conduit is attached to the dredging bucket such that it extends over a perimeter edge of the dredging bucket, into the space surrounding the exterior of the dredging bucket to enable the second float to lift the second end of the conduit to an elevated, floated position, when the dredging bucket is lowered into the dredging area, to enable the displacement of air in the conduit with water, so that as the dredging bucket is raised from the dredging area, above the water surface, the second end of the conduit descends into a freely suspended position from the dredging bucket, thereby creating a siphon to advance a flow of water from the dredging bucket, through the conduit, out of the second end thereof for removal of retained water back to the dredging site.

10. A method of dewatering a closed clamshell dredging bucket as recited in claim 9 further comprising the step of securing a member to the dredging bucket to receive and secure the conduit as it extends over a perimeter edge thereof, into the space surrounding the exterior of the dredging bucket.

11. A dewatering system for removing retained water from the interior volume of a closed clamshell dredging bucket loaded with excavated material that includes solids disposed below an upper layer of retained water, the dewatering system comprising:

at least one conduit adapted for support from a dredging bucket of the type that is movable from an open position arranged for being lowered into an area to be dredged, to a closed position for dredging material and sediments disposed below a surface of water in the area to be dredged;

said conduit having a first end adapted for placement within the interior volume defined by a closed dredging bucket, and a second end disposed for communication with the space surrounding the exterior of the dredging bucket, wherein the second end is disposed at a lower elevation than the first end when the dredging bucket is raised out of the dredging area;

a float disposed adjacent the first end of the conduit, secured thereto for lifting the first end to a raised elevation when the dredging bucket is placed below the surface of a body of water in a dredging area, wherein as the dredging bucket is raised from the body of water, the position of the float maintains the first end of the conduit adjacent the surface of retained water disposed within the dredging bucket as the retained water drains from the interior volume of the dredging bucket;

a second float disposed adjacent the second end of the conduit, secured thereto, wherein the conduit is attached to the dredging bucket such that it extends over a perimeter edge of the dredging bucket, into the space surrounding the exterior of the dredging bucket to enable the second float to lift the second end of the conduit to an elevated, floated position, when the dredging bucket is lowered into the dredging area, to enable the displacement of air in the conduit with water, so that as the dredging bucket is raised from the body of water, the second end of the conduit descends into a freely suspended position from the dredging bucket, thereby creating a siphon to advance a flow of water from the dredging bucket, through the conduit, out of the second end thereof for removal of retained water back to the dredging site.

12. A dewatering system as recited in claim 11 further comprising a member to receive and secure the conduit to the dredging bucket as it extends over a perimeter edge thereof, into the space surrounding the exterior of the dredging bucket.

* * * * *